United States Patent [19]

Menon et al.

[11] Patent Number: 4,795,918

[45] Date of Patent: Jan. 3, 1989

[54] BANDGAP VOLTAGE REFERENCE CIRCUIT WITH AN NPN CURRENT BYPASS CIRCUIT

[75] Inventors: Suresh M. Menon, Mountain View, Calif.; Jay L. Cohan, Cambridge, Mass.

[73] Assignee: Fairchild Semiconductor Corporation, Cupertino, Calif.

[21] Appl. No.: 45,950

[22] Filed: May 1, 1987

[51] Int. Cl.[4] ..... G05F 3/20

[52] U.S. Cl. ..... 307/297; 307/310; 323/313; 323/907

[58] Field of Search ..... 307/549, 246 R, 297, 307/310; 323/313-314, 907

[56] References Cited

U.S. PATENT DOCUMENTS

| | | | |
|---|---|---|---|
| 3,970,876 | 7/1976 | Allen et al. | 307/297 X |
| 4,322,676 | 3/1982 | Toyoda | 323/313 X |
| 4,570,114 | 2/1986 | Heim | 323/313 |
| 4,675,593 | 6/1987 | Minakuchi | 323/314 |

OTHER PUBLICATIONS

Brunin, "Adjusted Voltage Reference", *IBM TDB* vol. 19, No. 10, Mar. 1977, pp. 3758-3759.

*Primary Examiner*—Stanley D. Miller
*Assistant Examiner*—D. R. Hudspeth
*Attorney, Agent, or Firm*—Burns, Doane, Swecker & Mathis

[57] ABSTRACT

A temperature compensated bandgap voltage reference circuit employs an npn transistor based bypass circuit to maintain a constant collector current within the reference circuit. This bypass circuit draws a nominal current from the bandgap voltage reference circuit. The value of this current is set by a bias circuit responsive to changes in the supply voltage. As the supply voltage changes, the bias circuit varies the conductance of a bypass transistor to draw more or less current and thereby maintain the collector current within the reference circuit constant.

17 Claims, 2 Drawing Sheets

BANDGAP VOLTAGE REFERENCE CIRCUIT WITH AN NPN CURRENT BYPASS CIRCUIT

BACKGROUND OF THE INVENTION

The present invention is directed to voltage reference circuits, and in particular to bandgap voltage reference circuits for use with emitter coupled logic (ECL) and analog circuits.

Most ECL and analog logic gates require an appropriate voltage reference for proper operation. For example, some of these types of circuits require a voltage supply that must be substantially temperature-independent. One type of reference circuit that is typically employed to provide an appropriate voltage level is referred to as a bandgap voltage reference circuit. This circuit is so named because it provides an output voltage that is approximately equal to the bandgap voltage of silicon.

To facilitate an understanding of the objectives of the present invention, the details of a conventional bandgap voltage reference circuit will first be described. Referring to FIG. 1, a typical reference circuit includes a transistor 10 having an emitter connected to a supply voltage VEE by means of a resistor 12. By way of example, the supply voltage VEE might have a nominal potential of about −4.5 volts relative to a ground potential VCC. The collector of the transistor 10 is connected to the ground potential by means of a resistor 14 and the collector-emitter path of a transistor 16.

A diode connected transistor 18 has its common collector/base connected to the base of the transistor 10 by means of a resistor 20. The emitter of the transistor 18 is directly connected to the supply voltage VEE, and its collector/base is also connected to the ground potential VCC by means of a resistor 22 and a transistor 24.

Another transistor 26 also has its emitter directly coupled to the supply voltage VEE and its collector connected to the ground potential VCC by means of a voltage divider comprising resistors 28 and 30. The base of the transistor 26 is connected to the collector of the transistor 10. The bases of the transistors 16 and 24 are connected to the junction of the resistors 28 and 30 in the voltage divider. A compensation capacitor 31 is connected between the base and collector of the transistor 26 to provide stable operation.

In operation, the transistors 10, 18 and the resistors 12, 22 form a logarithmic current source in which the current density in the emitter of the transistor 10 is less than that of the transistor 18 because of the voltage developed across the resistor 12. The temperature variation of the collector current in the transistor 10 can be suitably adjusted through proper selection of the values for the resistors 12 and 22. The transistor 26 senses the temperature-dependent voltage that is developed across the resistor 14 and controls the current through the voltage divider 28, 30. The divided voltage developed across the resistors 28 and 30 is applied to the bases of the transistors 16 and 24. A temperature compensated output voltage VCS is produced at the emitter of the transistor 24.

The output voltage VCS is greater than the supply voltage VEE by an amount equal to the base emitter voltage of the transistor 26 ($V_{BE26}$) plus the voltage across the resistor 14 ($V_{R14}$). Under ideal conditions, any change in the supply voltage VEE should result in a corresponding change in the output voltage VCS. In other words, the value (VEE−VCS) should always remain constant. In practice, however, this condition does not occur with the circuit shown in FIG. 1.

For example, if the supply voltage VEE becomes more negative, to increase the absolute value of VEE−VCC, this increase in voltage develops across the resistor 30, causing an increase in current through this resistor. This condition causes a corresponding increase in the collector current of the transistor 26, resulting in an increase in its base-emitter voltage ($V_{BE26}$) Since the output voltage VCS is dependent upon $V_{BE26}$, the difference between the supply voltage VEE and the output voltage VCS will not remain constant. For example, at room temperature the ratio of the change in VCS to the change in VEE might be around 0.98. Ideally, this ratio should be 1.

To overcome this problem, the collector current in the transistor 26 must be maintained constant. In the past, one approach towards maintaining a constant collector current has been to substitute a pnp transistor current source for the resistor 30. The pnp transistor conducts in inverse proportion to the supply voltage changes, to thereby maintain a constant current through the collector of the transistor 26.

Alternatively, it has been proposed to place a pnp transistor in shunt across the resistor 28, to keep the current through this resistor constant.

These approaches which employ pnp transistors to maintain a constant current through the collector of the transistor 26 are not well suited for use in ECL circuits. More particularly, conventional ECL fabrication techniques are optimized for the production of good npn transistors, and result in the production of relatively poor quality pnp transistors. Typically, a pnp transistor produced by a conventional ECL process has a gain of 1 or less. Thus, the reliability of the pnp constant current source becomes process dependent in ECL circuits. It is desirable to avoid this drawback associated with previous approaches to providing a constant difference between the supply and output voltages.

BRIEF STATEMENT OF THE INVENTION

In accordance with the present invention, a temperature compensated bandgap voltage reference circuit employs a current bypass circuit to maintain a constant collector current within the reference circuit. This bypass circuit draws a nominal current from the bandgap voltage reference circuit. The value of this current is set by a bias circuit responsive to changes in the supply voltage. As the supply voltage changes, the bias circuit varies the conductance of a bypass transistor to draw more or less current and thereby maintain the collector current within the reference circuit constant.

The bypass circuit utilizes only npn transistors. Therefore, it can be readily incorporated into ECL bandgap reference circuits with good results.

DESCRIPTION OF THE ILLLUSTRATED EMBODIMENTS

To facilitate an understanding of the present invention and its applications, it is described with reference to bandgap voltage reference circuits that are employed in connection with ECL logic circuits. It will be appreciated, however, that the practical applications of the invention are not limited to this particular area of use.

Figure 1:
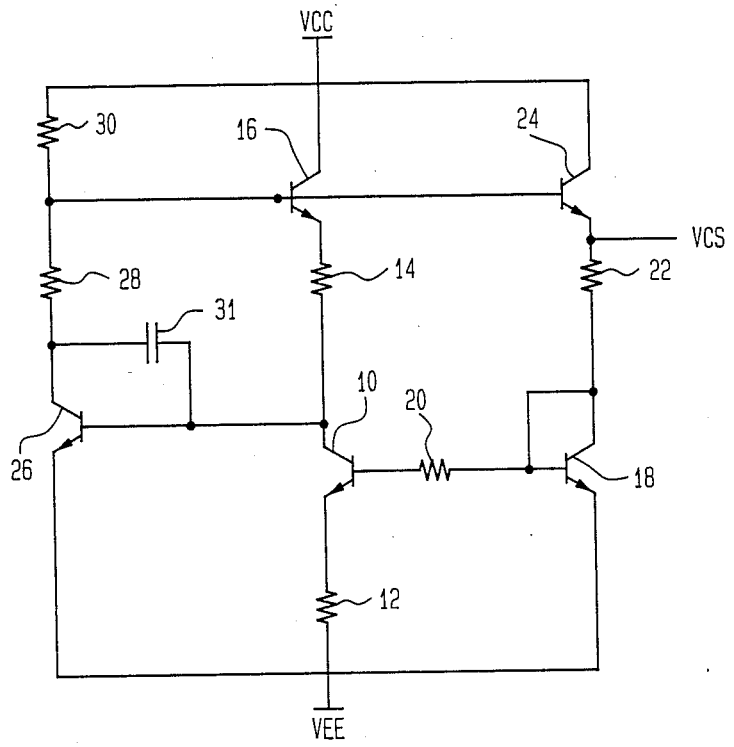
FIG. 1 is a schematic circuit diagram of a prior art bandgap voltage reference circuit.
Figure 2:
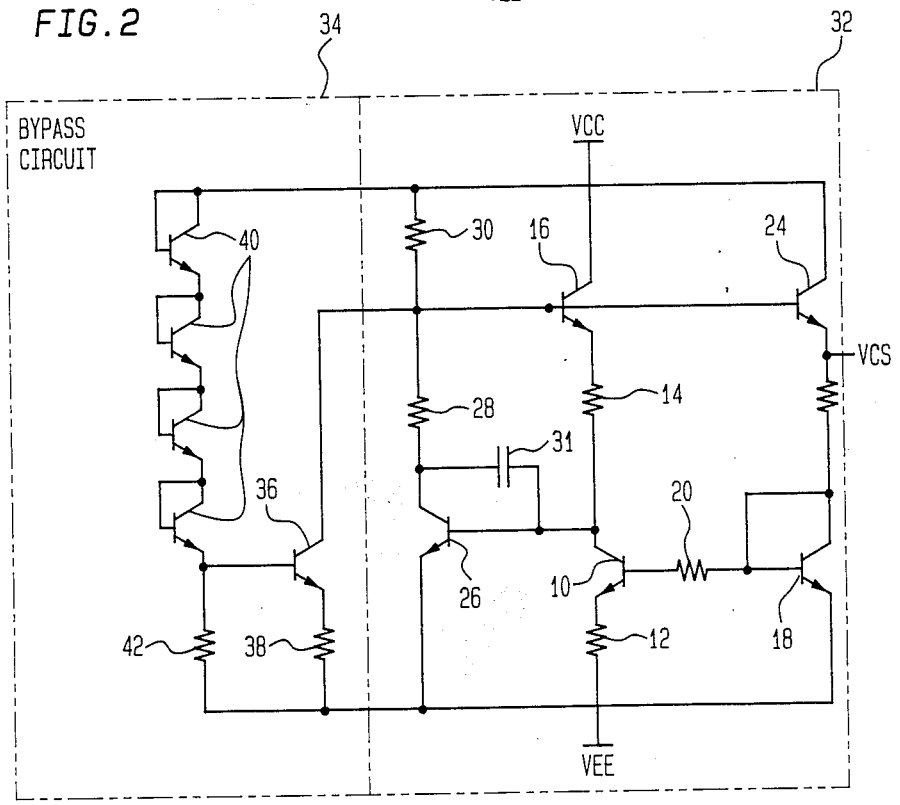
FIG. 2 is a schematic circuit diagram of a bandgap voltage reference circuit incorporating a bypass circuit in accordance with the present invention.

Referring to FIG. 2, a bandgap voltage reference circuit 32 incorporating the present invention has a configuration similar to the conventional circuit illustrated in FIG. 1. A bypass circuit 34 is connected to the voltage reference circuit 32 to maintain a constant current in the collector of the transistor 26. The bypass circuit includes an npn transistor 36 whose collector is connected to the junction of the resistors 28 and 30 in the reference circuit. The emitter of the transistor 36 is connected to the supply voltage VEE by means of a resistor 38 that is related in value to the resistor 30. The conductance of the transistor 36 is controlled by a bias circuit comprising a series of diode connected transistors 40 and a bias resistor 42.

In operation, the bypass circuit maintains a constant collector current in the transistor 26. At a nominal supply voltage, the bypass transistor 36 draws a nominal current whose magnitude is established by the bias circuit. In this bias circuit, the diodes 40 are referenced to the ground potential VCC, and changes in the supply voltage VEE are reflected across the bias resistor 42. The number of diodes 40 for the bias circuit is selected to provide a temperature coefficient for the bbiasing of the transistor 36 that will match the temperature coefficient of the voltage at the junction of the resistors 28 and 30. Preferably, the number of diodes is also chosen so as to keep the voltage at the base of the bypass transistor 36 sufficiently low to prevent saturation of the transistor.

If the resistance value of the resistor 38 is approximately equal to that of the resistor 30, a change in the supply voltage VEE will induce similar current changes through each of the resistors 38 and 30 and through the collector of the bypass transistor 36. Preferably, the bypass transistor 36 has a gain ($\alpha$) of approximately 1. Thus, when the supply voltage VEE increases to cause an increase in the current through the resistor 30, the bypass transistor 36 will draw the excess current, to ensure that the collector current of the transistor 26 remains constant. As a result, the output voltage VCS will accurately track changes in the supply voltage VEE to maintain a constant reference.

Table 1 below illustrates simulated results that were obtained with an embodiment of the prior art circuit of FIG. 1. In particular, the second, third and fourth columns of the table indicate the output voltage VCS that is obtained for three different values of supply voltage VEE at three different temperatures. The righthand column in the table indicates the ratio of the change in the output voltage to the change in the supply voltage for each temperature. As indicated previously, this ratio should ideally be equal to 1.

TABLE 1

| | VEE (volts) | | | |
|---|---|---|---|---|
| Temperature | −4.2 | −4.5 | −4.8 | $\frac{\Delta VCS}{\Delta VEE}$ |
| 25° C. | −2.9406 | −3.2347 | −3.5293 | .981 |
| 75° C. | −2.9302 | −3.2238 | −3.5179 | .980 |
| 125° C. | −2.9211 | −3.2141 | −3.5078 | .978 |
| | | VCS (volts) | | |

Table 2 below indicates similar results that were obtained with an embodiment of the circuit of FIG. 2, which had the same component values for the bandgap reference circuit but which included a bypass circuit in accordance with the present nnvention. From the results shown in this table, it can be seen that even in the worse case condition, i.e. the relatively high temperature of 125° C., the ratio of the change in the output voltage to the change in the supply voltage improves from 0.978 to 0.995.

TABLE 2

| | VEE (volts) | | | |
|---|---|---|---|---|
| Temperature | −4.2 | −4.5 | −4.8 | $\frac{\Delta VCS}{\Delta VEE}$ |
| 25° C. | −2.9518 | −3.2509 | −3.5501 | .997 |
| 75° C. | −2.9525 | −3.2514 | −3.5505 | .997 |
| 125° C. | −2.9589 | −3.2575 | −3.5560 | .995 |
| | | VCS (volts) | | |

Figure 3:
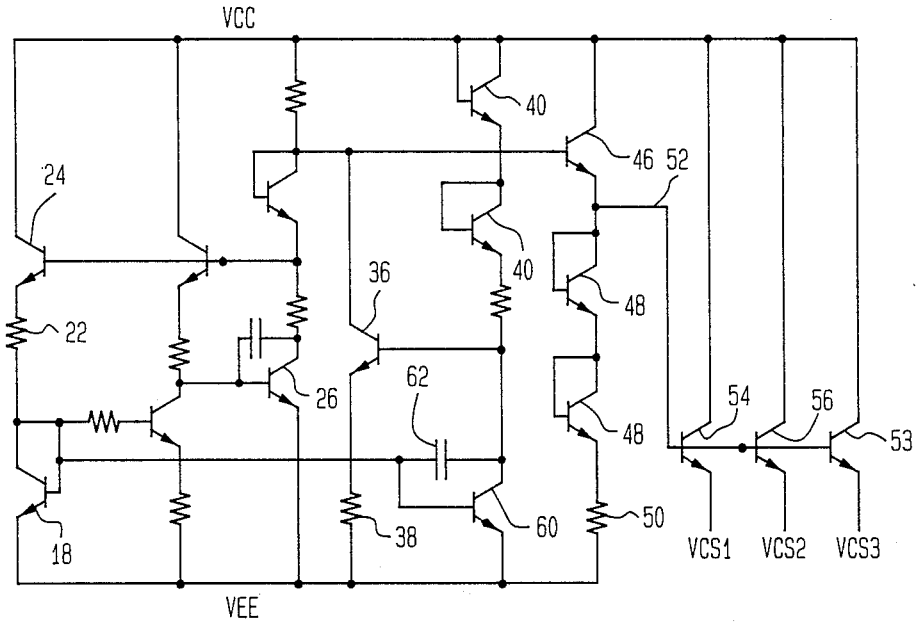
FIG. 3 is a schematic circuit diagram of an alternate embodiment of the invention.

An alternative, preferred embodiment of the invention is illustrated in the schematic circuit diagram of FIG. 3. Elements of this circuit which correspond to those in the circuit of FIG. 2 are identified with the same reference numeral. In the circuit of FIG. 2, the emitter of the transistor 24 serves as the output terminal for the circuit. In the circuit shown in FIG. 3, however, this node is not used to drive the output terminal. Rather, a different output driver is provided by means of a transistor 46 whose base is connected to the collector of the bypass transistor 36. The collector of this output transistor 46 is connected to the ground potential VCC, and its emitter is connected to the supply voltage VEE by mean of diode configured transistors 48 and a resistor 50.

An output voltage is obtained from an output line 52 connected to the emitter of the transistor 46. It will be appreciated that the voltage on this line is greater than the voltage at the emitter of the transistor 24 (the output terminal in the circuit of FIG. 2) by an amount equal to the base-emitter voltage of a transistor. To provide a voltage drop equal to this amount, satellite nodes formed by npn transistors 54, 56 and 58 are connected to the output line 52. The voltage VCS1, VCS2, etc. at the emitter of each satellite transistor corresponds to the voltage VCS appearing at the emitter of the transistor 24, and thus will have a temperature coefficient which is the same as that of the output voltage produced by the circuit of FIG. 2.

In a further variation of the invention shown in the circuit of FIG. 3, a transistor 60 is connected between the base of the bypass transistor 36 and the negative power supply VEE. The base of this transistor is connected to the base of the diode-connected transistor 18 to form a current mirror, along with the resistor 22. The current through the transistor 60 reflects the current through the transistor 18, so that the bias to the base of the transistor 36 has the same temperature coefficient as the output voltage VCS. A compensation capacitor 62 is connected between the base and collector of the transistor 60 to provide stability.

This further feature shown in the circuit of FIG. 3 provides improved results over a relatively large supply voltage range. Values of VCS for a particular embodiment of the prior art circuit of FIG. 1, over a supply voltage range of −4.0 to −5.8 volts, are shown in Table 3 below for two different temperatures:

TABLE 3

| | VEE (volts) | | | |
|---|---|---|---|---|
| Temperature | −4.2 | −4.5 | −5.8 | ΔVCS/ΔVEE |
| 25° C. | −2.7072 | −3.1894 | −4.4553 | 0.971 |
| 125° C. | −2.7125 | −3.1943 | −4.4582 | 0.970 |
| | | VCS (volts) | | |

It is to be noted that the particular embodiment that was used to produce the results of Table 3 had different component values than the embodiment used in the Table 1 data, thus accounting for the difference in VCS at −4.5 volts.

A bandgap voltage reference circuit having the same component values as the circuit ueed in the example of Table 3, but including a bypass circuit according to FIG. 3 provided the following results shown in Table 4:

TABLE 4

| | VEE (volts) | | | |
|---|---|---|---|---|
| Temperature | −4.0 | −4.5 | −5.8 | ΔVCS/ΔVEE |
| 25° C. | −2.6911 | −3.1895 | −4.4900 | 0.999 |
| 125° C. | −2.6906 | −3.1882 | −4.4875 | 0.998 |
| | | VCS (volts) | | |

As can be seen, the embodiment of FIG. 3 provides superior results.

Another advantage of the circuit shown in FIG. 3 is that it can be readily use to provide either a temperature-independent or a temperature-dependent supply voltage. More particularly, the circuits as shown in each of FIGS. 1 and 2 provide a substantially temperature-independent output voltage. In some applications, however, a fixed temperature coefficient is desired for the output voltage VCS. Such a result can be accomplished in each of the circuits of FIGS. 1, 2 and 3 by connecting a resistor between the base of the transistor 26 and the negative supply voltage VEE. Such a resistor is shown at 64 in the circuit of FIG. 4. This resistor provides a negative temperature coefficient for the reference voltage generating circuit that produces the output voltage VCS.

However, the presence of such a resistor presents certain difficulties when it is used with the circuit of FIG. 1 or FIG. 2. In the circuit of FIG. 1, the effect of supply voltage variation on the output voltgge VCS is exacerbated, i.e., ΔVCS/ΔVEE becomes even smaller. More particularly, since the base-emitter voltage of the transistor 26 varies in dependence upon the supply voltage, as described previously, the current through a resistor in shunt with the base and emitter of the transistor will also vary. Therefore, the temperature coefficient provided by the resistor will vary with supply voltage.

In the circuit of FIG. 2, it may be difficult to adjust the temperature coefficient of the bypass circuit to match that of the output voltage VCS without saturating or cutting off the bypass transistor 36. Thus, it would be difficult to ahieve a temperature dependent bias voltage with adequate rejection of supply voltage variations.

Figure 4:
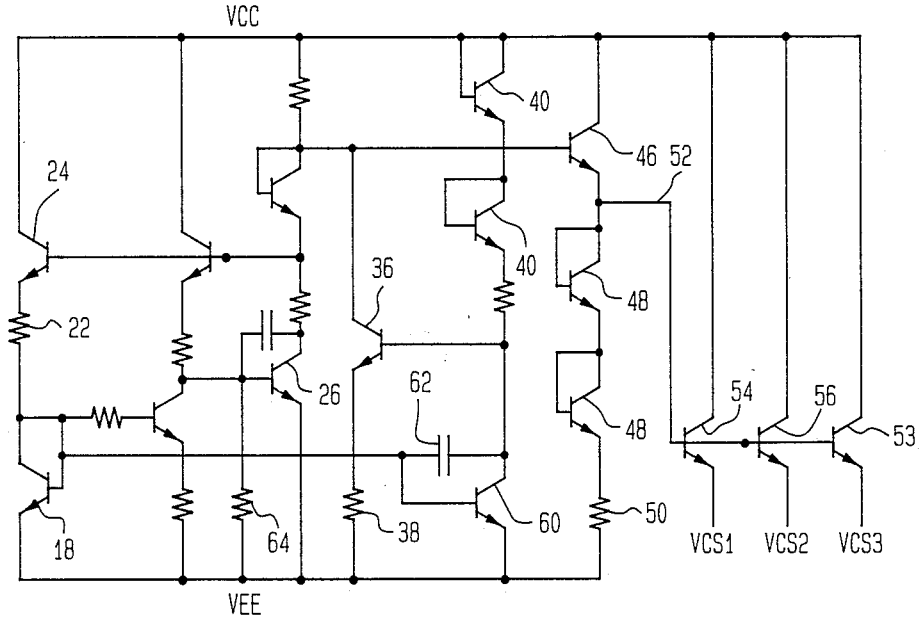
FIG. 4 is a schematic circuit diagram of an embodiment similar to FIG. 3 which produces a temperature-related output voltage.

However, in the circuit of FIG. 4, with the current mirror, the bias to the transistor 60 will reflect the same temperature coefficient as the output voltage VCS. Thus, an accurate temperature dependent voltage can be obtained without adversely affecting the operation of the bypass circuit.

It will be appreciated that the bypass transistor 36 in each embodiment of the invention will experience a similar phenomenon as the transistor 26 in the prior art circuit of FIG. 1, i.e. as the supply voltage changes its collector current will change, causing a corresponding increase or decrease in its base-emitter voltage. If the bypass resistor 38 is exactly equal in magnitude to the resistor 30 of the voltage reference circuit, this effect could limit the accuracy with which the output voltage tracks the supply voltage. To improve the operation of the circuit, it has been found that the value of the bypass resistor 38 should be slightly less than that of the resistor 30. More particularly, the ohmic value of the resistor 38, $R_{38}$, should have the following relationship to the ohmic value of the resistor 30, $R_{30}$:

$$R_{38} = \frac{\Delta VEE - (\Delta V_{be} + \Delta V)}{\Delta VEE} \times R_{30}$$

where:

ΔVEE is the expected change in supply voltage, $\Delta V_{be}$ is the change in the base-emitter voltage of the transistor 36, over the range of supply voltage variation; and ΔV is the change of the voltage at the base of the transistor 36 relative to VCC over the range of supply voltage variation.

It has been found that, when the values of the resistors 38 and 30 have this relationship, the ratio of changes in the output voltage VCS to changes in the supply voltage are improved even beyond the results indicated in Table 2, for example.

From the foregoing, it can be seen that the present invention provides a bypsss circuit that enables the collector current in the bandgap voltage reference circuit to be maintained constant. Since the bypass circuit only requires the same type of transistors as those found in the reference voltage circuit, i.e. npn transistors, it is well suited for fabrication by conventional ECL fabrication techniques, whcch are optimized for the production of these types of transistors.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embraced therein.

What is claimed is:

1. A bandgap voltage reference circuit for producing an output voltage that is related to a power supply potential, comprising:

a first npn transistor having an emitter connected to said power supply potential and a collector connected to a second potential by means of a first resistance;

a second npn transistor having an emitter connected to said power supply potential by means of a second resistance and a collector connected to a base of said first transistor;

a third resistance for connecting said collector of said second transistor to said second potential;

an output terminal operatively coupled to at least one of the collector of said first transistor and said third resistance to produce an output voltage that differs from said power supply potential by an amount related to a base-emitter voltage of said first transistor plus a voltage across said third resistance; and a bypass circuit including an npn bypass transistor having a collector connected to a junction between said first resistance and the collector of said first transistor and an emitter connected to said power supply potential by a bypass resistor, and a bias circuit connected to a base of said bypass transistor for maintaining the current through the collector of said first transistor substantially independent of changes in said supply potential.

2. The reference circuit of claim 1 wherein said bias circuit includes a plurality of diodes connected in series between the base of said bypass transistor and said second potential.

3. The reference circuit of claim 2 wherein said bias circuit further includes a bias resistor connected between the base of said bypass transistor and said supply potential.

4. The reference circuit of claim 1 wherein said bias circuit includes a current mirror connected to the base of said bypass transistor to provide a bias current having a temperature coefficient corresponding to that of said output voltage.

5. The reference circuit of claim 1 wherein said bypass resistor has a resistance value that is substantially the same as the resistance value of said first resistance.

6. The reference circuit of claim 1 wherein said bypass resistor has a resistance value that is less than that of said first resistance.

7. In a temperature compensated voltage reference circuit of the type which produces an output voltage related to the current flowing in an npn sensing transistor, a bypass circuit for maintaining the current in said transistor substantially independent of changes in a supply voltage applied to said transistor, said bypass circuit including an npn bypass transistor connected in shunt across said sensing transistor to draw current away from said sensing transistor, and a bias circuit for controlling said bypass transistor in accordance with changes in said supply voltage, said bias circuit including a plurality of diodes and a resistor connected in series across a source of said supply voltage, a junction of said diodes and said resistor being connected to a base of said bypass transistor.

8. The reference circuit of claim 7 further including a bypass resistor connected in series with a collector-emitter current path of said bypass transistor.

9. The circuit of claim 8 wherein said reference circuit includes an output control resistor in series with a collector-emitter current path of said sensing transistor, and said bypass resistor has a value related to the value of said output control resistor.

10. The circuit of claim 9 wherein the magnitude of said bypass resistor is approximately equal to that of said output control resistor.

11. The circuit of claim 9 wherein the magnitude of said bypass resistor is less than that of said output control resistor.

12. In a voltage reference circuit of the type which produces a temperature compensated output voltage in accordance with the magnitude of current flowing in a sensing transistor of a particular conductivity type, a method for maintaining the current in said sensing transistor substantially independent of changes in a supply voltage applied to said transistor, comprising the steps of shunting some current away from said sensing transistor through a bypass transistor of the same conductivity type, varying the amount of current that is shunted away in accordance with changes in said supply voltage, and biasing said bypass transistor with a current having a temperature coefficient which is the same as the temperature coefficient of said output voltage.

13. In a temperature compensated voltage reference circuit of the type which produces an output voltage related to the current flowing an an npn sensing transistor, a bypass circuit for maintaining the current in said transistor substantially independent of changes in a supply voltage applied to said transistor, said bypass circuit including an npn bypass transistor connected in shunt across said sensing transistor to draw current away from said sensing transistor, and a bias circuit for controlling said bypass transistor in accordance with changes in said supply voltage, said biasing circuit including a current mirror connected to the base of said bypass transistor, said current mirror providing a bias current which reflects a temperature dependency of said output voltage.

14. The reference circuit of claim 13 further including a bypass resistor connected in series with a collector-emitter current path of said bypass transistor.

15. The circuit of claim 14 wherein said reference circuit includes an output control resistor in series with a collector-emitter current path of said sensing transistor, and said bypass resistor has a value related to the value of said output control resistor.

16. The circuit of claim 15 wherein the magnitude of said bypass resistor is approximately equal to that of said output control resistor.

17. The circuit of claim 15 wherein the magnitude of said bypass resistor is less than that of said output control resistor.

* * * * *